US008431519B2

(12) United States Patent
Scarella et al.

(10) Patent No.: US 8,431,519 B2
(45) **Date of Patent: *Apr. 30, 2013**

(54) CO-GRANULATES OF BLEACH ACTIVATOR-PEROXIDE COMPOUNDS

(75) Inventors: Robert Scarella, Valhalla, NY (US); Georg Borchers, Bad Nauheim (DE)

(73) Assignee: OCI Chemical Corp., Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/770,642

(22) Filed: Apr. 29, 2010

(65) Prior Publication Data

US 2010/0207062 A1 Aug. 19, 2010

Related U.S. Application Data

(63) Continuation of application No. 11/413,131, filed on Apr. 27, 2006, now Pat. No. 7,709,437.

(51) Int. Cl.

| | |
|---|---|
| ***C11D 17/00*** | (2006.01) |
| ***C11D 11/00*** | (2006.01) |
| ***C11D 3/39*** | (2006.01) |
| ***C11D 3/395*** | (2006.01) |
| ***C11D 7/38*** | (2006.01) |
| ***C11D 7/54*** | (2006.01) |

(52) U.S. Cl.

USPC ..... 510/376; 510/378; 510/312; 510/313; 510/314; 510/444; 252/186.27; 252/186.3; 252/186.38

(58) Field of Classification Search ..... 510/376, 510/378, 312, 313, 314, 444; 251/186.27, 251/186.3, 186.38; 252/186.27, 186.3, 186.38

See application file for complete search history.

(56) References Cited

U.S. PATENT DOCUMENTS

| | | | | | |
|---|---|---|---|---|---|
| 4,064,062 | A | * | 12/1977 | Yurko | 8/111 |
| 4,283,302 | A | * | 8/1981 | Foret et al. | 510/313 |
| 4,372,868 | A | | 2/1983 | Saran | |
| 4,378,300 | A | * | 3/1983 | Gray | 510/312 |
| 4,422,950 | A | * | 12/1983 | Kemper et al. | 252/186.38 |
| 4,664,837 | A | * | 5/1987 | Gray | 510/310 |
| 4,678,594 | A | * | 7/1987 | Parfomak et al. | 252/186.31 |
| 4,681,592 | A | * | 7/1987 | Hardy et al. | 510/313 |
| 4,726,908 | A | * | 2/1988 | Kruse et al. | 510/378 |
| 5,002,679 | A | * | 3/1991 | Tai | 252/186.38 |
| 5,716,569 | A | * | 2/1998 | Berenbold et al. | 264/115 |
| 6,133,214 | A | * | 10/2000 | Jung et al. | 510/296 |
| 7,504,372 | B2 | * | 3/2009 | Reinhardt et al. | 510/375 |

FOREIGN PATENT DOCUMENTS

| | | | | |
|---|---|---|---|---|
| DE | 0037026 | A1 | | 3/1981 |
| DE | 19858887 | A1 | * | 6/2000 |
| EP | 0791647 | A2 | * | 8/1997 |
| WO | WO2006/027179 | A1 | * | 3/2006 |

* cited by examiner

*Primary Examiner* — Lorna M Douyon

(74) *Attorney, Agent, or Firm* — Kinne IP Group

(57) ABSTRACT

A process for preparation of co-granules including one or more bleach activators and one or more bleach agent compounds is described. The bleach component is mixed and coated with a binder selected from the group of fatty acids, fatty acid polyol esters, polyglycols and fatty alcohol oxalkylates. One or more bleach activators is added to this mixture followed by granulation or agglomeration in a mixer, resulting in a bleach co-granule composition including the bleach activator and peroxide components.

19 Claims, No Drawings

CO-GRANULATES OF BLEACH ACTIVATOR-PEROXIDE COMPOUNDS

CROSS REFERENCE TO RELATED APPLICATIONS

This application is a continuation application of U.S. patent application Ser. No. 11/413,131, filed on Apr. 27, 2006 now U.S. Pat. No 7,709,437.

FIELD OF THE INVENTION

This invention relates to compositions including a bleaching agent. In particular, the invention relates to bleaching compositions provided in granule form for use in laundry, cleaning and as disinfection agents, as well as in textile treatment and wood, pulp and paper bleaching, for example. More particularly, the invention is related to methods of making co-granules of bleach activator/peroxide compounds and compositions made thereby, and especially, for example, bleach activator/percarbonate co-granules having good storage stability and improved bleaching performance in a broad variety of applications.

BACKGROUND OF THE INVENTION

Inorganic peroxide compounds, such as hydrogen peroxide, solid peroxides, which release hydrogen peroxide by dissolving in water (e.g. sodium perborate and sodium percarbonate perhydrate), have been used as oxidants for disinfection and bleaching for a long time. The oxidation properties of such compounds are strongly dependent on temperature. For example, hydrogen peroxide or perborate in alkaline bleaching liquors show satisfactory, accelerated bleach performance on soiled textiles only at temperatures above 80° C.

At lower temperatures, the efficiency of oxidation of an inorganic peroxide compound can be improved by addition of bleach activators. These bleach activators include N- or O-acyl compounds, e.g. multiple acylated alkylene diamines, especially tetra acetyl ethylene diamine and tetra acetyl glycouril, N-acylated hydantoines, hydrazines, triazoles, hydrotriazines, urazoles, di-keto piperazines, sulfurylamides, and cyanurates, as well as carboxylic acid anhydrides, especially phthalic acid anhydride and substituted maleic acid anhydrides, carboxylic acid esters, especially sodium-acetoxybenzene sulfonate, sodium-benzoyloxy benzene sulfonate (BOBS), sodium-nonanoyloxy benzene sulfonate (NOBS), sodium-lauroyloxy-benzene sulfonate (LOBS), sodium-isononanoyloxy benzene sulfonate (Iso-NOBS) and acylated sugar derivatives, like pentaglucose. In the presence of such bleach activator substances, the bleach performance of aqueous peroxide solutions can be improved such that similar bleaching results are achieved at a temperature range of 40-50° C., comparable to those of sole peroxide solutions at 95° C. Mixtures of bleach activators may be used as well, which may include both hydrophilic and hydrophobic bleach activators. Mainly, hydrophobic components derivatives of the readily water soluble sodium-phenolsulfonates are used, e.g. nonanoyloxy benzene sulfonate, acetoxy benzene sulfonate or benzoyloxy benzene sulfonate. These hydrophobic compounds are preferably combined with tetra acetyl ethylene diamine. Also, bleach activators based on hydroxy benzoic acids and derivatives thereof show effective bleach performance.

Bleach activators in the form of granules are preferred as bleaching components in combination with substances generating hydrogen peroxide, e.g. sodium perborate or sodium percarbonate for use in laundry, cleaning, and disinfection applications, in textile and fiber treatment preparations, and in the wood, pulp and paper industries. In order to avoid the premature reaction of a bleach activator and peroxide compounds resulting in a loss of bleach performance, a number of processes have been developed to stabilize such systems by granulation, using binders and other additives and to eventually protect the granules by coating.

For example, EP 0 037 026 shows a process for the production of a readily dissoluble granulated activator containing 90% to 98% active matter. The bleach activator in powdered form is homogenously mixed with cellulose or starch ethers in powdered form, followed by spray-on of an aqueous solution of the cellulose or starch ether, followed by granulation processing and a drying step. Because of the gelling of the cellulose and starch ethers in water, causing poor flow properties and low adhesive power, the activator granules according to this reference are less than optimally stable.

In EP 1.447 380 A1, a process for the production of sodium percarbonate is shown. A hydrogen peroxide solution is sprayed onto sodium carbonate while simultaneously drying in an air current. This process yields granules having less than optimal solubility characteristics, especially at low washing temperatures, with resultant, less than optimal bleach performance.

U.S. Pat. No. 5,458,801 discloses a process for producing bleach activators comprising core granules of sodium percarbonate or sodium perborate. The activators are coated with borate, mixed in the presence of water-soluble binders and then granulated. The use of boronic compounds raises toxicological concerns, and therefore these are not preferred components in laundry and cleaning formulations. U.S. Pat. No. 5,458,801 teaches that a granulation process of percarbonate and bleach activators is only possible if the percarbonate is coated with borate.

There is a demand, therefore, for methods and compositions, that combine a bleach activator and bleach material in a form which is easy to produce and highly effective while providing long term shelf stability. The present invention satisfies the demand.

SUMMARY OF THE INVENTION

One aspect of the present invention provides a method for manufacturing bleach granules, containing at least one bleach activator and at least one bleach component (also referred to herein as peroxide component). To provide better bleach performance, the bleach activator and the peroxide components may be combined closely and formulated to have better storage stability and yet also be readily dissolvable.

In a preferred embodiment, a process for preparation of co-granules including at least one bleach activator and at least one peroxide compound, wherein the peroxide component is mixed and coated with a binder selected from the group of fatty acids, fatty acid polyol esters, polyglycols and fatty alcohol oxyalkylates, is disclosed. Bleach activator is added to this mixture, followed by agglomeration in a high-shear mixer, to provide co-granules including bleach activator and peroxide components.

In another preferred embodiment, the co-granules of bleach activator and peroxide components are produced by mixing the bleach activator with a binder selected from the group of fatty acids, fatty acid polyol ester, polyglycols and fatty alcohol oxyalkylates. A peroxide component is then added, followed by agglomeration in a high-shear mixer, yielding co-granules including bleach activator and peroxide components. If desired, the co-granules can be coated using standard coating materials and methods.

Therefore, preferred embodiments provide co-granules of a bleach activator and a peroxide component including one or more peroxide compounds, one or more bleach activators and at least one of a fatty acid, fatty acid polyol ester, polyglycol or fatty alcohol oxyalkylates.

In another embodiment, a process for the production of co-granules of one or more bleach activator and one or more peroxide component, including mixing and coating a peroxide component with one or more of a fatty acid, a fatty acid polyol ester, a polyglycol, and a fatty alcohol oxyalkylates, is disclosed. The bleach activator(s) is added in solid form. The resulting mixture is agglomerated in a high-shear mixer.

In yet another embodiment, mixing and coating a bleach activator with one or more of a fatty acid, a fatty acid polyol ester, a polyglycol, and/or a fatty alcohol oxyalkylate is disclosed. The peroxide component is added in a solid form. The resulting mixture is agglomerated in a high-shear mixer.

While the claims concluding the specification particularly point out and distinctly claim the precise subject matter regarded as invention, the preferred embodiments may be best understood from the following detailed description.

DETAILED DESCRIPTION OF PREFERRED EMBODIMENTS

The term bleach may be used in the contexts of both soil removal and whitening. For example, in common fabric and textile cleaning, bleach will react with and dissociate certain soils (i.e. tea, wine stains) thereby removing them from the surface of the fabric they are adhered to. Also, bleach, as an oxidizer, will break apart light absorbing chemical configurations called chromophores, rendering the oxidized material colorless.

Bleaching can also be applied to soil on hard surfaces. Additional potential applications are in personal care, e.g. bleaching hair, improving cleaning properties of denture cleaners, etc. Furthermore, the bleach compounds, or oxidizing compounds formulated according to the preferred embodiments herein, can be used in industrial cleaning applications, for bleaching wood, pulp and paper, for bleaching cotton, as well as for germ-killing formulations.

The preferred embodiments herein may also be used for cleaning textiles and hard surfaces, especially dishes, by using bleach activator compounds in combination with peroxygen components in an aqueous solution. These can contain additional materials for washing and cleaning hard surfaces, and more particularly, for cleaning dishes, for which use in an automatic dish washing application is preferred.

Preferred peroxide components include perborate-monohydrate, perborate-tetrahydrate, percarbonates, alkali persulphates, persilicates, and percitrates in which sodium is the preferred alkali metal, as well as hydrogen peroxide adducts of urea or amine oxides. Additionally or alternatively, peroxycarboxylic acids, e,g, dodecane di-peracid or phthalimido percarboxylic acids, can be used which can be substituted at the aromatic ring. Addition of small amounts, for example, less than one percent by weight, of stabilizers of the bleaching agents, like phosphonates, meta silicates, as well as manganese and magnesium salts, is contemplated by alternate embodiments.

The co-granules of the bleach activator and peroxide components may include fatty acids or fatty acid polyol esters. Fatty acids comprise linear or branched, saturated or unsaturated fatty acids having 6 to 30 C-atoms, and preferably 10 to 22 carbon atoms. Examples of fatty acids include but are not limited to capronic acid, caprylic acid, 2-ethyl-hexanoyic acid, palmitoleinic acid, stearic acid, isostearic acid, oleic acid, elaidinic acid, petroselinic acid, linolic acid, linoleic acid, elaeosterinic acid, arachinic acid gadoleinic acid, behenic acid, eurucaic acid, and dimers of unsaturated fatty acids. More preferable are fatty acid carbon chain fractions of coconut oil, palm oil or tallow, most preferably stearic acid.

In a further preferred embodiment, the co-granules of bleach activator and peroxide component comprise fatty acid poly esters. These esters can be produced by esterification of polyvalent alcohols with fatty acids. Especially preferred are stearic acid esters of pentaerythritol, and even more preferred are pentaerythritol distearate. Useful as polyvalent alcohols are glycol, benzene glycol, propylene glycol, butylene glycol, butane diol, methylpropane diol, pentylene glycol, iso-pentyl diol, neopentyl glycol, hexylene glycol, hexane diol, ethylhexane diol, diethylene glycol, methoxy diglycol, ethoxy diglycol, butoxy diglycol, dimethoxy diglycol, dipropylene glycol, glycerol, oligo glycerol, poly glycerol, four-valent alcohols, e.g. erythrose, threose, especially pentaerythritol, five-valent alcohols, e.g. arabitol, adonitol, xylitol, six-valent alcohols, e.g. sorbitol, mannitol, dulcitol, as well as saccharides, e.g. ribose, xylose, lyxose, altose, glucose, fructose, galactose, arabinose, mannose, gulose, idose, talose, and desoxy sugars, like Rhamnose and fructose, disaccharides, e.g. cane-sugar, trehalose, lactose, maltose, gentiobiose, melibiose, cellobiose, oligo and poly saccharides, e.g. cellotriose, cellotetrose, raffinose, acarbose, as well as starch and its components amylose, amylopektin, and dextrines, dextranes, Xanthanes, or cellulose. Suitable for esterification reactions are all linear or branched, saturated and/or unsaturated fatty acids having 6 to 30 C-atoms, preferably 10 to 22 carbon atoms, as mentioned above.

The fatty acid esters according to the preferred embodiments can also be obtained by transesterifiaction of fatty acid methylesters with polyvalent alcohols or fatty acid triglycerides. The carbon chain in fatty acid methylesters consists of 8 to 22 carbon atoms, being linear or branched, saturated or unsaturated. Examples are palmitic acid, stearic acid, lauric acid, linolic acid, linoleic acid, isostearic acid or oleic acid. Fatty acid triglycerides comprise all native animal or vegetable based oils, fats, and waxes, e.g. olive oil, rapeseed oil, palmkernel oil, sunflower oil, coconut oil, linseed oil, castor oil, soybean oil, also in their refined or hydrogenated forms.

Saccharide esters can be obtained in good yields by reaction of saccharides with activated fatty acid derivatives, e.g. fatty acid chlorides or anhydrides in the presence of an amine base, e.g. pyridine.

Polyglycerol esters are preferred, e.g. diglycerol-140 EO-tristearate, sorbitan fatty acid esters, e.g. sorbitan oleate, ethoxylated polyethylene glycol stearates, esters of dextrines having a degree of polymerization of 3 to 200, preferably 5 to 100, most preferably 10 to 50, especially fatty acid esters of dextrine palmitate esters, as well as disaccharide esters, especially esters of cellobiose, most preferably cellobiose palmitate esters, esters of pentaerythritol, PEG especially pentaerythritol stearic acid esters, most preferably pentaerythritol distearate.

In one preferred embodiment, the co-granules of bleach activator and peroxide component include effective amounts of:

a) tetraacetyl ethylene diamine (TAED)
b) sodium percarbonate
c) stearic acid and/or pentaerythritol distearate.

In another preferred embodiment, the co-granules of bleach activator and peroxide components include:

a) one or more bleach activators in ratios from 1 to 50 weight-%, preferably from 1 to 20 weight-%, most preferably from 5 to 10 weight-% b) one or more peroxide components in ratios from 50 to 99 weight-%, preferably from 75 to 99 weight-%, most preferably from 80 to 90 weight-% c) one or more fatty acid or fatty acid esters in ratios from 1 to 50 weight-%, preferably from 1 to 20 weight-%, most preferably from 5 to 10 weight-%.

Thus, the ratio of bleach activator to peroxide component may be in the range of 1:0.5 to 1:20 parts by weight, and preferably 1:1 to 1:5 parts by weight.

Furthermore, in another preferred embodiment, the co-granules of bleach activator and peroxide component comprise additional binders, additives, and carriers. The group of binders includes cellulose, starch, ethers and esters thereof, for example carboxymethyl cellulose (CMC), methyl cellulose (MC) or hydroxyethyl or hydroxypropyl cellulose (HEC, HPC) and the corresponding starch derivatives, and can also include film-forming polymers like polyacrylic acids and salts thereof. Preferred binders include anionic compounds in powder form, especially cumeme, xylene, toluene sulphonates, alkylethersulphates, alkylsulphates, α-olefin sulphonates and soaps. The amount of binder based on finished granule can range from about 1 to 45 weight-%, preferably from about 5 to 30 weight-%.

The co-granules of bleach activator-peroxygen compound are used in detergent formulations according to the invention in concentrations of about 0.1 to 15%, preferably about 1 to 8%. In prespotters or disinfectants, the concentration of the bleach activator compound up to about 50% can be applied.

Granulation of the bleach activator-peroxygen compounds can be performed in known mixing equipment, either in a batch process or a continuous process. Suitable mixing devices include plough shear mixers (Ladige KM types, Drais K-T types) as well as other highly effective mixing devices, e.g. Eirich, Schugi, Ladige CB-types, Drain K-TT types). All mixing processes producing satisfactory mixing efficacy can be utilized.

According to another embodiment, all of the components are mixed simultaneously. Alternatively, the peroxygen compound is preferably mixed with a molten binder and homogenized. In a second step, the bleach activator is added, and the composition is granulated in a high-speed mixer.

One preferred mixer for preparing these preferred compositions is a Littleford Day Horizontal Plow Mixer, a medium intensity mixer that creates a mechanically fluidized bed of material. The mixer includes a horizontal cylinder or drum with a central shaft from which mixing tools radiate. The mixing tools cover the entire surface of the drum, eliminating dead spots where product would be unmixed. The mechanically fluidized bed provides for rapid mixing, effective heat transfer for both cooling and heating, and incorporation of liquids onto the materials. Rapid, accurate mixing of dry components is easily accomplished due to the mixing tools moving the material from end to end in the drum. Liquids can be sprayed onto the fluidized material bed from as low as 0.5% to 50%, i.e., to a point where the material becomes a paste or has a dough-like consistency. Use of an optional jacket can provide heat input for reactions, drying, melting of material in a coating operation, or as means to make a paste such as hot melt adhesives. Cooling of the product can also be accomplished with the jacket.

The mixers can be equipped with high speed choppers, mounted in a back lower quadrant of the mixer. These choppers impart high shear to the material, allowing for dispersion of material and incorporation of viscous liquids that are hard to spray. The chopper blade configuration can be changed to increase or decrease the shear input as needed. The mixers can be built as pressure vessels and vacuum rated per the process needs.

Materials may be discharged from the mixer through a contour door or a valve mounted in the center of the mixer bottom. The discharge of materials from the mixer is normally quite rapid. Additional valves can be added to the discharge door or valve to control the output flow therethrough for packaging, for example.

The residence time in the granulator is preferably 0.5 seconds to 20 minutes, and more preferably about 2 minutes to 10 minutes. In another preferred process option, a drying and/or cooling step is employed after granulation, to reduce or avoid stickiness of the granules produced. Post-treatment processes may be performed in the same mixer types described above or in conventional fluidized bed equipment. Coarse and fine particles may be separated by sieving. The coarse fraction may be milled and fed back into the granulation process together with the fines fraction.

Furthermore, in another preferred embodiment, the peroxygen compound, fatty acid or poly ester (binder), and optionally other solid, liquid or molten additives are fed into the mixing device and are homogenized. The mixture is heated to temperatures above the melting point of the binder. The bleach activator is added to this mixture to obtain a plastified mass. Mixing devices as mentioned above can be used, but also kneaders or specific extruder types (e.g. Extrud-o-mix of Hosokawa-Bepex Corp.) are suitable. The mass from the granulation step can be processed into extrudates by appropriate equipments, as extruder-types (e.g. single-screw and twin-screw, dome and basket extruders), a flat die press or a ring die press. Such equipment is available from companies such as Schlüter, Amandus-Kahl, Hosokawa Bepex, Fuji-Paudal or Händle. The extrudates are sized to the desired dimension in a post-treatment step. Optionally a spheronizer can be used for bead making.

After sizing of the granules, residual water can be removed to increase particle stability. Drying and/or cooling can be performed using the same mixer types described above, or in conventional fluidized bed equipment. Coarse and fine particles may be separated by sieving. The coarse fraction may be milled and fed back into the granulation process together with the fines fraction.

Coating

The granules can be directly used in laundry and cleaning products. However, in a more preferred form, a coating is be applied. Through coating, using film forming substances, the product properties can be influenced significantly.

Suitable coating materials include waxes, silicones, fatty acids, fatty alcohols, soaps, anionic surfactants, nonionic surfactants, cationic surfactants, anionic and cationic polymers, and polyalkylene glycols. Coating materials having a melting point in the range of 30 to 100° C. are preferred, e.g. C8-C31 fatty acids (e.g. lauric, myristinic, or stearic acid), C8-C31 fatty alcohols, polyalkylene glycols having a molecular weight of 1000 to 50000 g/mol, fatty alcohol oxyalkylates containing 1 to 100 moles of EO, alkane sulfonates, alkyl benzene sulfonates, α-olefins sulfonates, alkyl sulfates, alkyl ether sulfates, polymers (e.g. polyvinyl alcohols), and waxes (e.g. montane waxes, paraffin waxes, ester waxes, polyolefin waxes, silicones).

The coating materials can contain other materials either dissolved or suspended, like homo, co, or crafted co-polymers of unsaturated carboxylic acids and/or sulfonic acids, as well as alkali salts thereof, cellulose ethers, starch, starch ethers, polyvinyl pyrrolidone, mono and polyvalent carboxylic acids, hydroxy carboxylic acids or ether carboxylic acids having 3 to 8 carbon atoms, as well as salts thereof, silicates, carbonates, bicarbonates, sulfates, phosphates, and phosphonates. Depending on the desired properties, the coating material can be applied from 1 to 30 weight-percent, preferably 5 to 15 weight-% of the total coated granule. For coating, conventional mixers and fluidized bed devices can be used. Suitable mixers include, e.g. plough-shear mixers or Schugi Mixers.

The bleach activator-peroxygen compound-co-granulates according to the preferred embodiments described above can be used in laundry and cleaning products, as well as products used to kill germs. Major components of those consumer products include anionic surfactants, nonionic surfactants, builder systems (such as zeolites, phosphates, polymers, sodium carbonate, silicates and layered silicates), organic builders, enzymes, anti-redeposition agents (such as soil release polymers and dye transfer inhibitors), and other ingredients as known in the art, such as colors and fragrances, etc.

METHOD EXAMPLES

Two exemplary processes are provided hereinbelow to illustrate the manufacture of the bleach/bleach activator co-granule according to the invention.

1.) Sodium Percarbonate is charged to the mixing vessel along with the formulation amount of fatty acid. The mixer used is a Littleford Day MGT Series Vertical mixer/granulator with medium intensity vortex mixing using a single, four blade impeller located at the base of the mixer. The mix is heated to a temperature above the melting point of the fatty acid. The impeller RPM is raised to 1500 RPM. After 2 minutes of mixing, the mixer is stopped and the formulation amount of TAED is added. The mixing then continues for 30 seconds at a mixer speed of 1200 RPM. The mixing is then stopped and the batch is discharged.

2.) In a separate vessel, melt the fatty acid, add the formulation amount of TAED to the molten fatty acid. Charge the same mixer described in item #1 above with the formulation amount of sodium percarbonate and mix at a speed of 1200 RPM. After 1 minute stop mixing, add the molten mix of fatty acid and TAED to the sodium percarbonate, start the mixer and mix for 1 minute at a mixer speed of 1200 RPM. After 1 minute of mixing, discharge the mixer.

The formulation amounts used in both examples were:

| Raw Material | wt. % |
|---|---|
| Sodium Percarbonate | 83 |
| TAED | 10 |
| Fatty Acid | 7 |
| Total | 100 |

The mixers used were Lodige type, high speed mixers designed for efficient liquid dispersion on powders, and better control on product density and particle size distribution.

Table I shows median particle size for the tests conducted on the material made in the above examples. Data regarding median particle size (d50) was obtained using the ISO 3118 method.

TABLE I

| Trial # | d 10 (mic.) | d50 (mic.) | d90 (mic.) |
|---|---|---|---|
| 1 | 354 | 604 | 1070 |
| 2 | 326 | 577 | 966 |
| 3 | 309 | 580 | 987 |

Table II shows median particle size, dissolution and stability data in a set of six different co-granulations made according to the invention. Data reflecting available oxygen is generated using "a standard potassium permanganate titration method." Data reflecting median particle size is obtained using the ISO 3118 standard industrial method. Data reflecting stability percentage is obtained by measuring the remaining amount of available oxygen in the product (as a percentage of the original amount) after accelerated storage at industry standard test conditions.

TABLE II

| Trial # | Wt. % Sodium Percarbonate | Wt. % Stearic Acid | Wt. % Fatty Acid Polyol Ester | Wt. % TAED | Wt. % Available Oxygen | Median Particle Size d50 (microns) | Stability (%) |
|---|---|---|---|---|---|---|---|
| 1 | 83 | 8 | | 9 | 10.7 | 604 | 84 |
| 2 | 84 | 7 | | 9 | 11.1 | 577 | 94 |
| 3 | 84 | | 7 | 9 | 10.1 | 685 | 71 |
| 4 | 83 | 8 | | 9 | 10.2 | 596 | 82 |
| 5 | 89 | | 2.5 | 8.5 | 12.0 | 589 | 70 |
| 6 | 83 | 8 | | 9 | 9.4 | 700 | 96 |

The described embodiments are to be considered in all respects only as illustrative and not restrictive, and the scope of the invention is, therefore, indicated by the appended claims rather than by the foregoing description. Those of skill in the art will recognize changes, substitutions and other modifications that will nonetheless, come within the scope of the invention and range of the claims.

What is claimed is:

1. A co-granular composition comprising co-granulate formed from (i) mixing and coating one of a bleach activator and a bleach component with a molten binder to form a molten mixture, and (ii) agglomerating said molten mixture with the other of the bleach activator or the bleach component to form a co-granulate, wherein the bleach component is present in the co-granulate in an amount of 75-99% by weight.

2. The co-granular composition of claim 1, wherein said bleach component includes one or more of sodium percarbonate and sodium perborate.

3. The co-granular composition of claim 1, wherein said bleach activator includes one or more of an N— or O-Acyl compound, an acylated alkylene diamine, tetra acetyl glycouril. N-acylated hydaMoine, hydrazine, triazole, hydratriazine, urazole, di-ketopiperazine, sulfurylamide, cyanurate, a carboxylic acid anhydride, sodium-acetoxy-benzene sulfonate, sodium-benzoyloxy benzene sulfonate (BOBS), sodium-lauroyloxy-benzene sulfonate (LOBS), sodium-isononanoyloxy benzene sulfonate (iso-NOBS), acylated sugar derivatives, pentaglucose, tetra acetyl ethylene diamine (TAED), and sodium-nonanoyloxy benzene sulfonate (NOBS).

4. The co-granular composition of claim 1, wherein said bleach activator includes both hydrophilic and hydrophobic bleach activators.

5. The co-granular composition of claim 1, wherein said binder includes one or more of fatty acids, fatty acid polyol esters, polyglycols and fatty alcohol oxyalkylates.

6. The co-granular composition of claim 1, further including a bleaching agent stabilizer selected from the group consisting of a meta silicate and a magnesium salt.

7. The co-granular composition of claim 1, wherein said binder is present at about 5-10% by weight.

8. The co-granular composition of claim 1, wherein the co-granulate has a median particle size between about 550 and about 700 microns.

9. The co-granular composition of claim 1, wherein the co-granulate has a density between about 900 and 1050 grams/Liter.

10. A method of forming co-granulates of bleach composition, comprising:

mixing and coating one of a bleach activator and a bleach component with a binder at a time and temperature sufficient to form a molten mixture;

adding to the molten mixture the other of the bleach activator and the bleach component;

agglomerating the resulting mixture to form a co-granulate;

wherein the bleach component is present in the co-granule in an amount of 75-99% by weight.

11. The method of claim 10, wherein the bleach activator is present in the co-granulate at an amount from about 5-10% by weight, the bleach component is present in the co-granulate at an amount from about 80-90% by weight and the binder is present in the co-granulate at an amount from about 5-10% by weight.

12. The method of claim 10, wherein the bleach activator comprises one or more of an N— or O-Acyl compound, an acylated alkylene diamine, tetra acetyl glycouril, an N-acylated hydantoine a hydrazine, a triazole, a hydratriazine, a urazole, a di-ketopiperazine, a sulfurylamide and a cyanurate.

13. The method of claim 10, wherein the bleach activator comprises tetra acetyl ethylene diamine (TAED), 14. The method of claim 10, wherein the bleach activator comprises sodium-nonanoyloxy benzene sulfonate (NOBS).

15. The method of claim 10, further comprising processing the co-granulate to produce a median particle size between 300 and 900 microns.

16. The method of claim 10, wherein the bleach component is selected from the group consisting of sodium percarbonate and sodium perborate.

17. The method of claim 10, wherein the binder is selected from the group consisting of fatty acids, fatty acid polyol esters, polyglycols and fatty alcohol oxyalkylates.

18. The method of claim 10, wherein the granulate is mixed for 2 to 10 minutes in a granulator at a temperature of 30 to 100 degrees C.

19. A method of forming co-granulates of bleach composition, comprising:

mixing one of a bleach activator and a bleach component with a binder for between 2 to 10 minutes at a temperature of between 30-100 degrees C. to form a molten mixture wherein the binder substantially coats the one of a bleach activator and a bleach component; and adding to the molten mixture the other of the bleach activator and the bleach component; agglomerating the resulting mixture to form a co-granulate;

the bleach activator being selected from the group consisting of an N— or O-Acyl compound, an acylated alkylene diamine, tetra acetyl glycouril, an N-acylated hydantoine, a hydrazine, a triazole, a hydratriazine, a urazole, a di-ketopiperazine, a sulfurylamide and a cyanurate;

the bleach component being selected from the group consisting of sodium percarbonate and sodium perborate and is present in the co-granulate in an amount of 75-99% by weight; and the binder being selected from the group consisting of fatty acids, fatty acid polyol esters, polyglycols and fatty alcohol oxyalkylates.

* * * * *